US011230865B2

(12) United States Patent
Held

(10) Patent No.: US 11,230,865 B2
(45) Date of Patent: Jan. 25, 2022

(54) DOOR-LOCKING MECHANISM HAVING A RECEPTACLE SET INTO THE DOOR FRAME FOR THE LOCKING BOLT OF A DEVICE SET INTO THE DOOR FOR CONTROLLING THE LOCKING BOLT INTO THE OPEN POSITION BY MEANS OF A MANUALLY CONTROLLABLE ACTUATING ELEMENT

(71) Applicant: FORM ORANGE PRODUKTENTWICKLUNG, Hard (AT)

(72) Inventor: Wofgang Held, Hard (AT)

( * ) Notice: Subject to any disclaimer, the term of this patent is extended or adjusted under 35 U.S.C. 154(b) by 581 days.

(21) Appl. No.: 16/301,375

(22) PCT Filed: May 19, 2016

(86) PCT No.: PCT/EP2016/061328
§ 371 (c)(1),
(2) Date: Nov. 13, 2018

(87) PCT Pub. No.: WO2017/198305
PCT Pub. Date: Nov. 23, 2017

(65) Prior Publication Data

US 2020/0318403 A1 Oct. 8, 2020

(51) Int. Cl.
*E05C 1/06* (2006.01)
*E05B 5/00* (2006.01)
(Continued)

(52) U.S. Cl.
CPC ..... *E05C 1/065* (2013.01); *E05B 5/00* (2013.01); *E05B 47/0038* (2013.01);
(Continued)

(58) Field of Classification Search
CPC ..... Y10T 292/102; Y10T 292/096; Y10T 292/1014; Y10T 292/0977;
(Continued)

(56) References Cited

U.S. PATENT DOCUMENTS 4,707,006 A * 11/1987 Garg ..... E05C 9/00 292/336.3
5,127,686 A * 7/1992 Gleason ..... E05B 5/00 292/216
(Continued)

FOREIGN PATENT DOCUMENTS

DE 202006003307 U1 * 5/2006 ..... E05B 5/00
GB 2112052 A * 7/1983 ..... E05C 1/145
(Continued)

*Primary Examiner* — Kristina R Fulton
*Assistant Examiner* — Steven A Tullia
(74) *Attorney, Agent, or Firm* — John Alumit

(57) ABSTRACT

The invention relates to a door closer mechanism having a receptacle, countersunk in the door frame, for the deadbolt of a device, countersunk in the door, for controlling the deadbolt from the closing position to the opening position by means of a manually controllable actuation member. So that, without an additional key-actuated lock, the closing position can be locked in the closing position and fixed without making the ease of adjustment into the opening position more difficult, the invention provides that the actuation member of the device countersunk in the door is embodied as a handle recess, which in the closing position controls a slide via a rotatably supported angled control piece, and the slide, via a rotatably supported lever, secures the deadbolt in the receptacle in the door frame, and upon actuation of the recessed handle in the door, via the angled control piece and the slide, the deadbolt can be adjusted into the opening position of the door, and the door is enabled to open.

7 Claims, 8 Drawing Sheets

Figure 2:
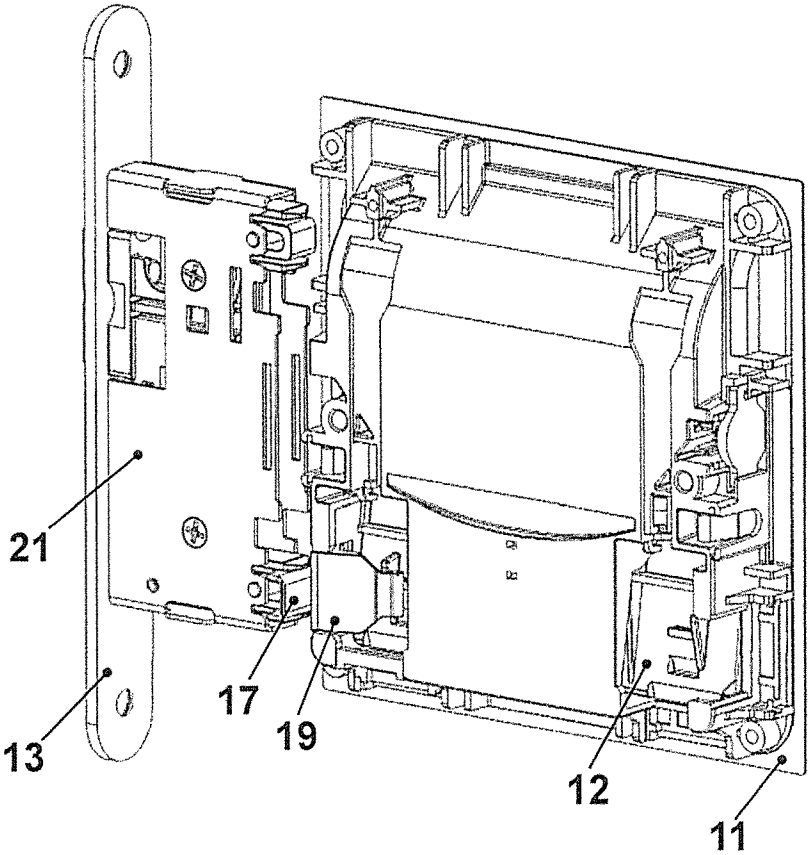

(51) Int. Cl.
*E05B 47/00* (2006.01)
*E05B 63/00* (2006.01)
*E05B 63/04* (2006.01)

(52) U.S. Cl.
CPC ..... *E05B 63/0056* (2013.01); *E05B 63/04* (2013.01); *E05Y 2900/132* (2013.01)

(58) Field of Classification Search
CPC ..... Y10T 292/1016; E05C 1/065; E05B 5/00; E05B 47/0038; E05B 63/0056; E05B 63/04; Y10S 292/31; Y10S 292/63; Y10S 292/68; E05Y 2900/132
USPC ..... 292/138, 169, 140, 143
See application file for complete search history.

(56) References Cited

U.S. PATENT DOCUMENTS 5,413,391 A * 5/1995 Clavin ..... E05C 1/145 292/170
5,820,175 A * 10/1998 Clavin ..... E05C 1/145 292/165
6,145,352 A * 11/2000 Vickers ..... E05B 63/14 70/208
2010/0154489 A1* 6/2010 Bacon ..... E05B 57/00 70/77
2010/0257905 A1* 10/2010 Tsai ..... E05B 7/00 70/91
2012/0299314 A1* 11/2012 Jiang ..... E05B 45/083 292/137
2013/0076046 A1* 3/2013 Shah ..... E05B 63/0056 292/336.3
2015/0001859 A1 1/2015 Minix

FOREIGN PATENT DOCUMENTS

GB 2182713 A * 5/1987 ..... E05B 47/0038
JP H05 118173 A 5/1993
JP 2002 295102 A 10/2002
JP 2009 197538 A 9/2009

* cited by examiner

DOOR-LOCKING MECHANISM HAVING A RECEPTACLE SET INTO THE DOOR FRAME FOR THE LOCKING BOLT OF A DEVICE SET INTO THE DOOR FOR CONTROLLING THE LOCKING BOLT INTO THE OPEN POSITION BY MEANS OF A MANUALLY CONTROLLABLE ACTUATING ELEMENT

The invention relates to a door closer mechanism having a receptacle, countersunk in the door frame, for the deadbolt of a device, countersunk in the door, for controlling the deadbolt from the closing position to the opening position by means of a manually controllable actuation member.

One such door closer mechanism is known in which the manually adjustable actuation member is embodied as a door handle. When the door handle is turned, the deadbolt is moved out of the receptacle in the door frame, so that the door can be opened. For locking the door in the closing position, a lock that is locked with a key is integrated into the door closer mechanism. This makes the door closer mechanism complicated and makes it manufacture more expensive.

It is the object of the invention to further develop a door closer mechanism of the type mentioned at the outset in such a way that without an additional key-actuated lock, its closing position is locked and fixed in the closing position, yet this does not make its easy adjustment into the opening position more difficult.

The stated object is attained by the features of claim 1.

This is attained in that the actuation member of the device countersunk in the door is embodied as a recessed handle, which in the closing position controls a slide via a supported angled control piece; the slide, via a rotatably supported lever, secures the deadbolt in the receptacle in the door frame, and upon actuation of the recessed handle in the door, the deadbolt can be adjusted, via the angled control piece and the slide, into the opening position of the door, and the door is enabled to open.

When the recessed handle is not actuated, the door closer mechanism is always fixed in its closing position and can be put into the opening position and the door opened by actuating the recessed handle; opening the door does not require any additional means in the door closer mechanism. Such a door closer mechanism is especially well suited as a toilet door, which in a simple way makes an adjustment of the opening position of the door also possible.

The recessed handle is preferably let flush into a frame in the device in the door and can be moved out of the frame in such a way that in the process it adjusts the angled control piece, the slide and the lever such that the deadbolt moves all the way out of the receptacle in the door frame. The device with the recessed handle is integrated into the door in such a way that it assumes four different positions, which are each rotated 90° from one another; the recessed handle can be moved out of the frame that is joined to the door either toward the bottom, to the left, toward the top, or to the right. In this way, the structure can always be adapted to the most-favorable position for use.

The recessed handle, except for a handle opening, extends beyond the frame and thus makes it easier to grasp the recessed handle to actuate the door closer mechanism.

The recessed handle is coupled to the angled control piece in such a way that when the recessed handle is moved out, the control lever is turned and the slide can be adjusted parallel to the deadbolt; the adjustable slide rotates the lever far enough, and the slide can be adjusted parallel to the deadbolt so far, that the deadbolt has completely moved out of the receptacle in the door frame.

The deadbolt is guided in a plate that is connectable to the front side of the door. This plate is connected to a plate vertically to it, which has the locator pins for the rotational support of the lever and for the adjustment of the slide; the lever is rotatably supported on the locator pin, and the slide, provided with guide receptacles, is displaceable on the locator pin.

The lever, the slide, and the deadbolt are covered by a plate that is parallel to the plate having the locator pins.

The angled control piece is rotatably supported in the frame around the recessed handle.

The deadbolt can also have one or more permanent magnets. The angled control piece, made of electromagnetically conductive material, can be adjusted into the vicinity of these permanent magnets upon actuation of the recessed handle. In the process, the deadbolt is adjusted into the opening position, and in the closing position of the recessed handle, a spring restores the deadbolt into its closing position back into the receptacle in the door frame.

Figure 1:
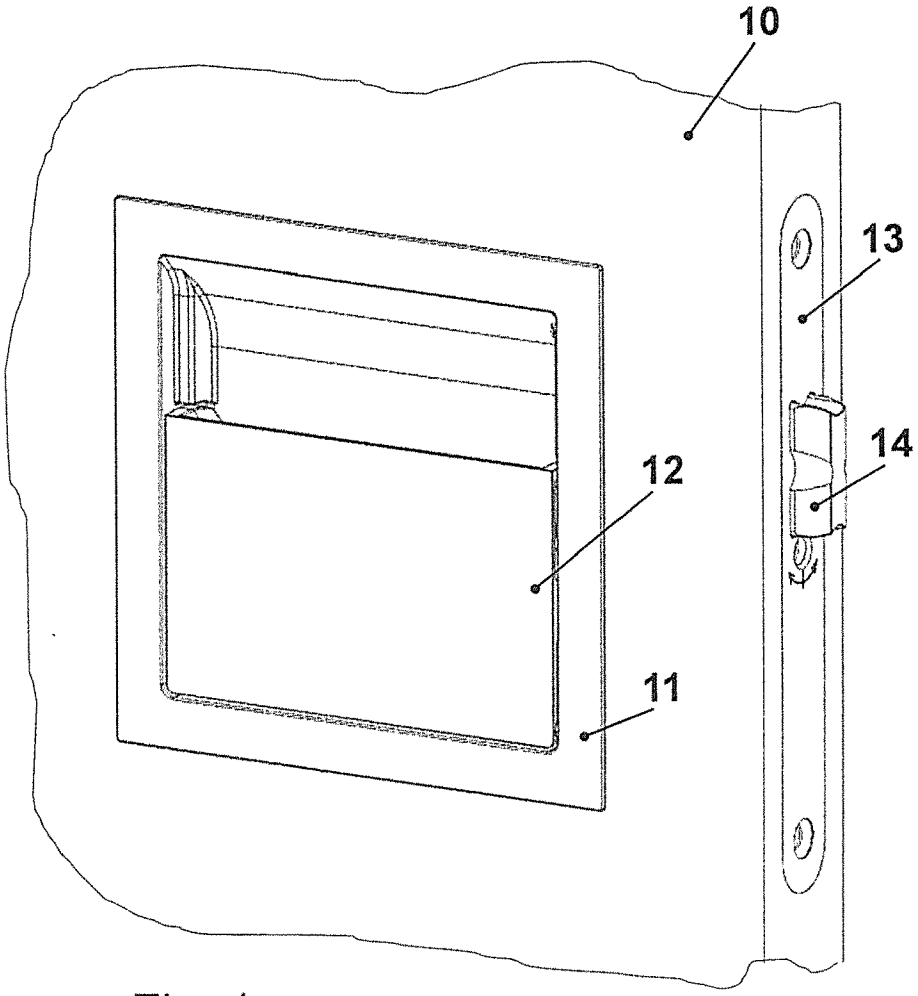
Figure 3:
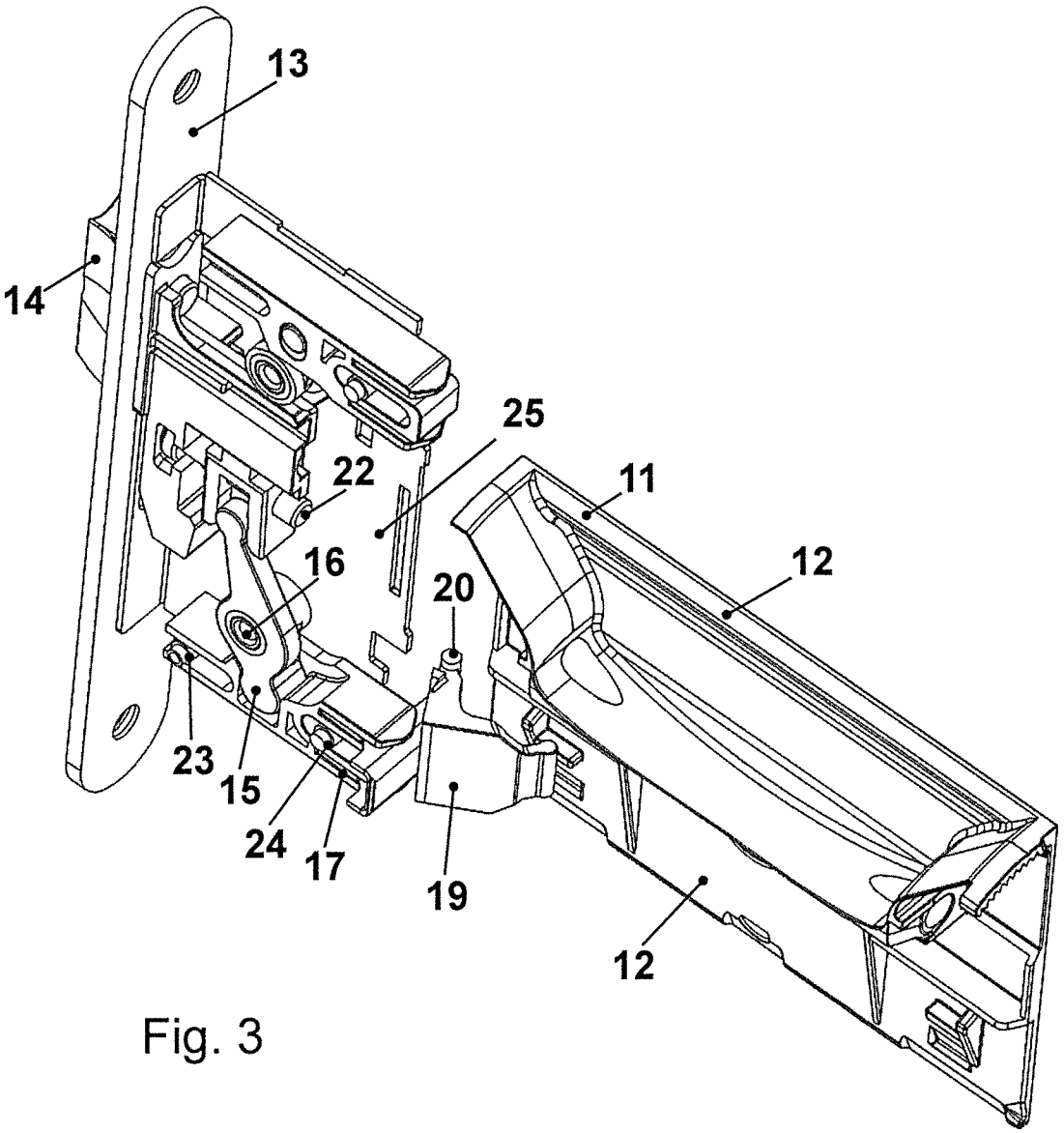
Figure 5:
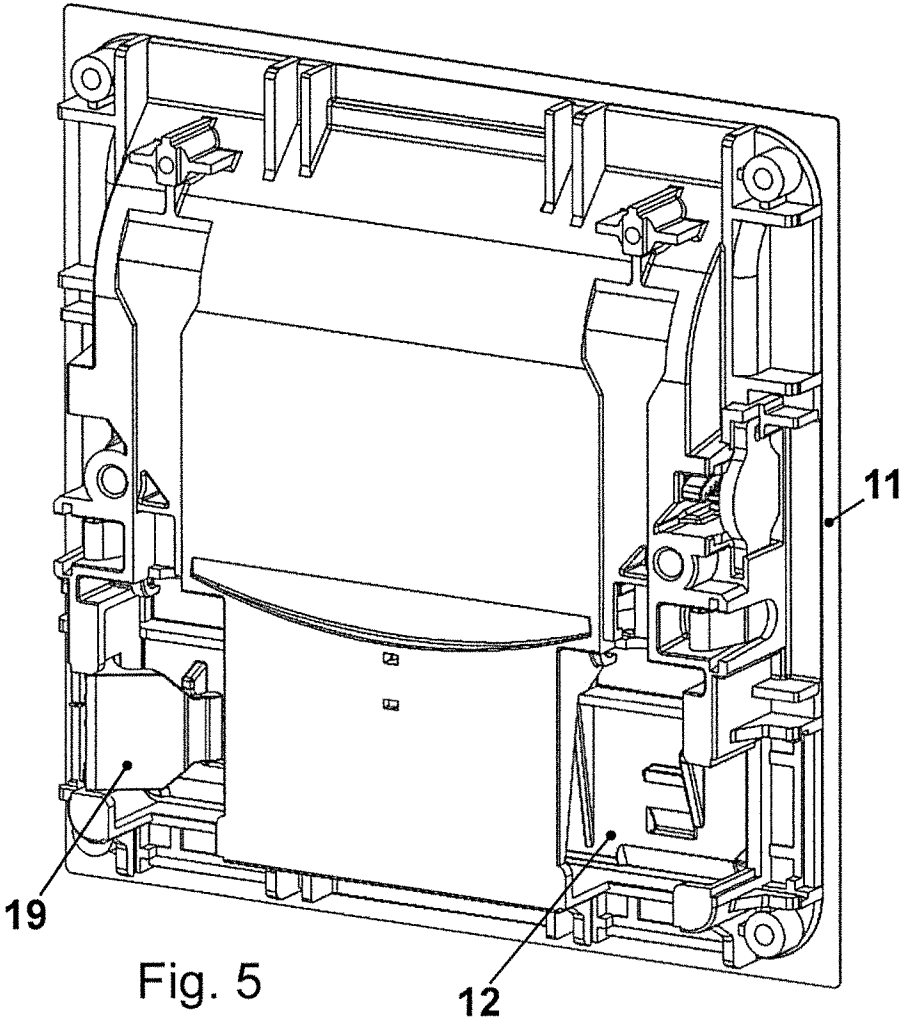
Figure 4:
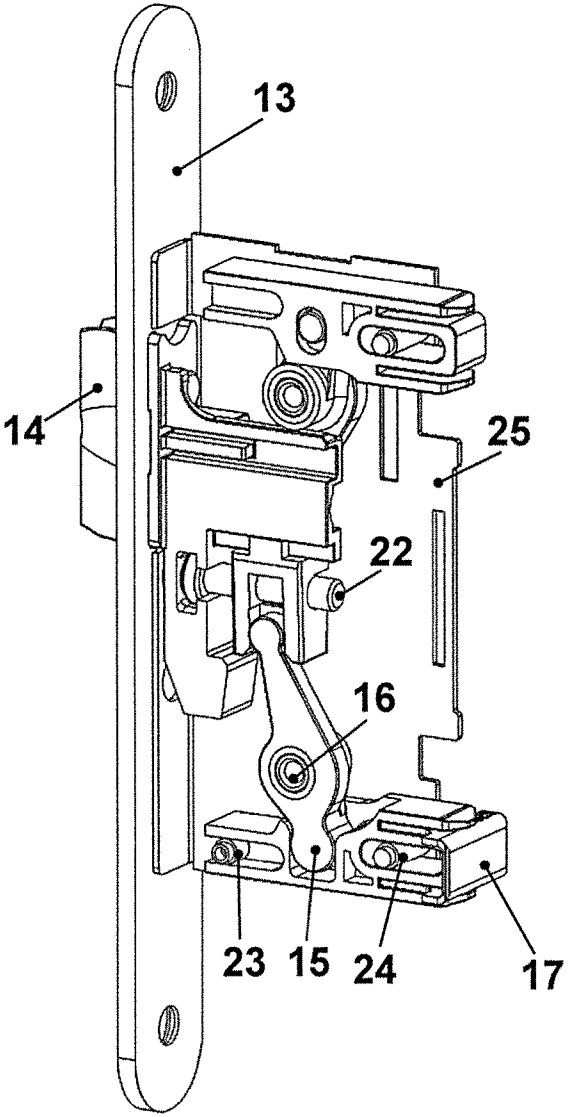
Figure 7:
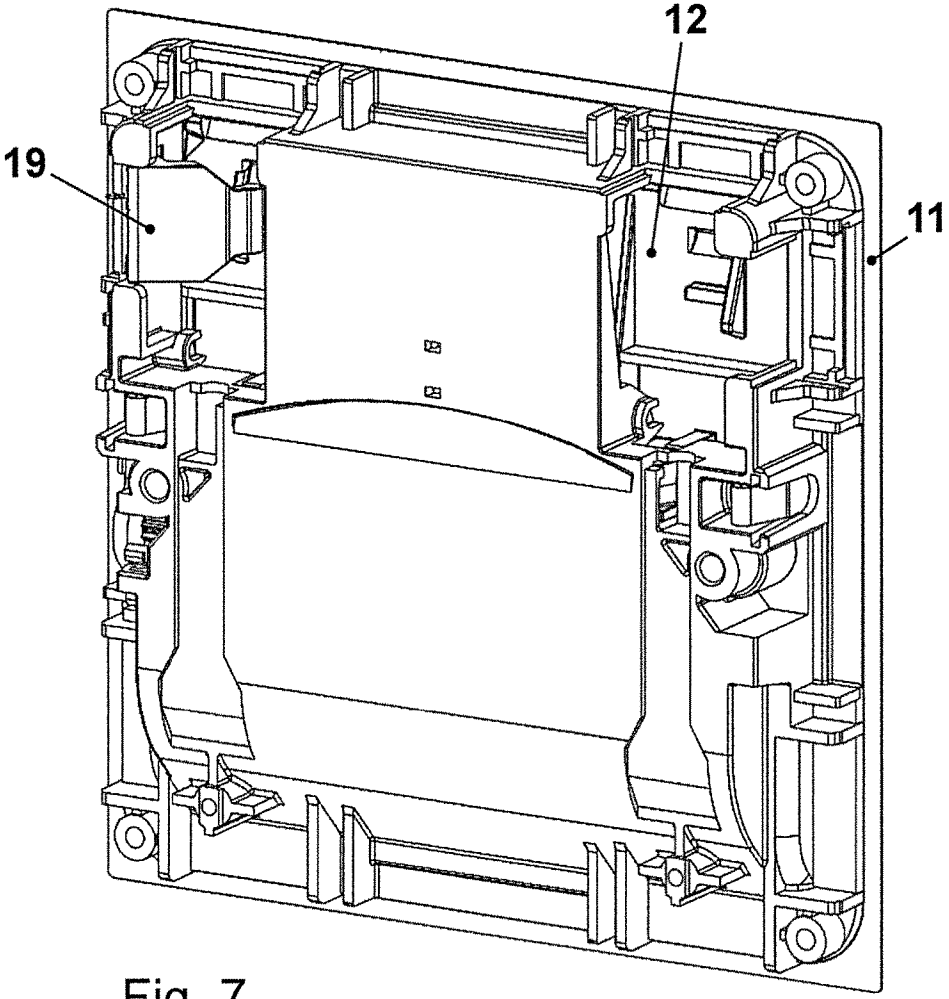
Figure 6:
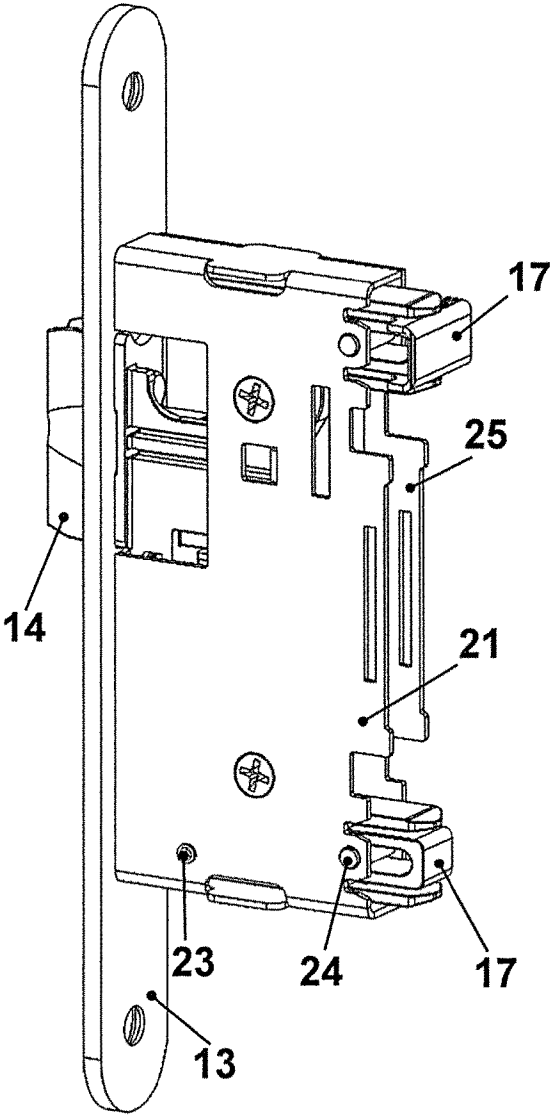
Figure 9:
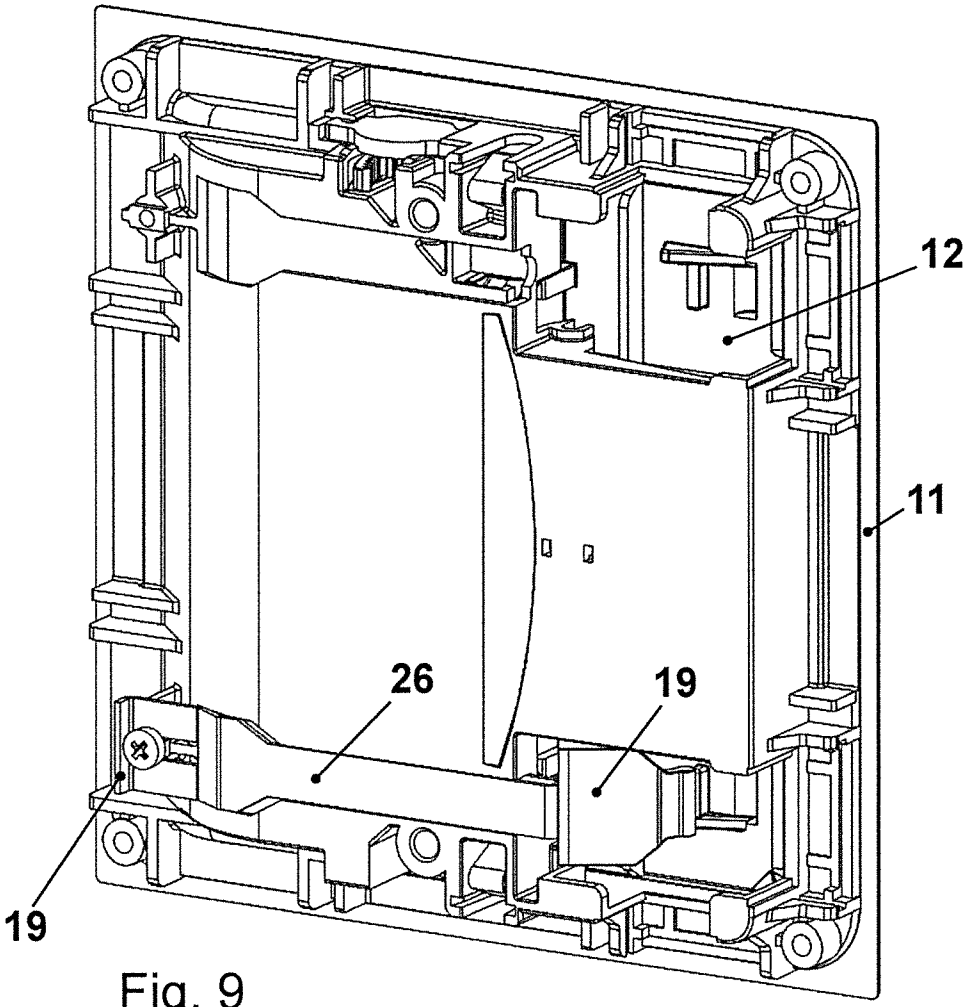
Figure 8:
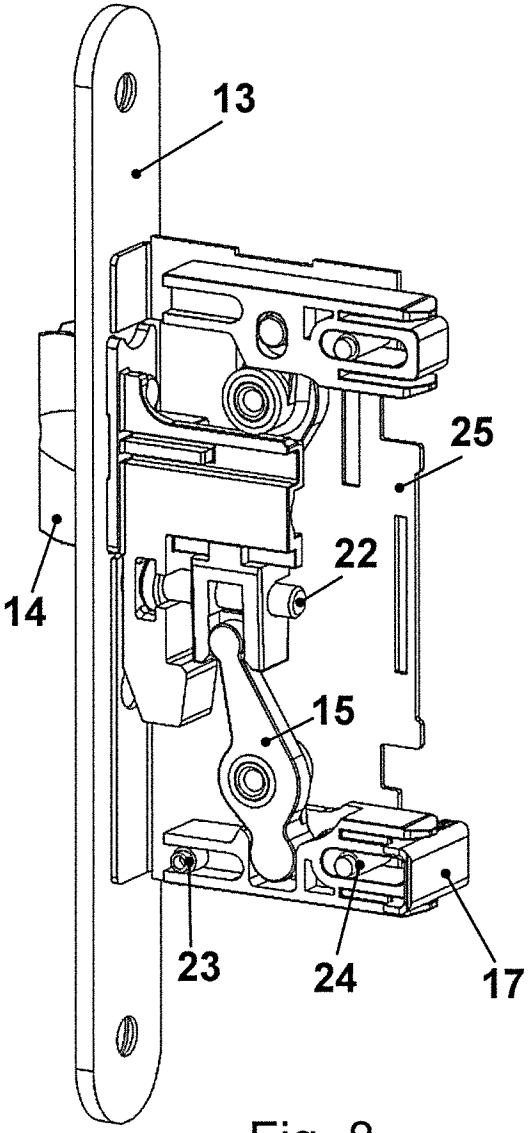
Figure 11:
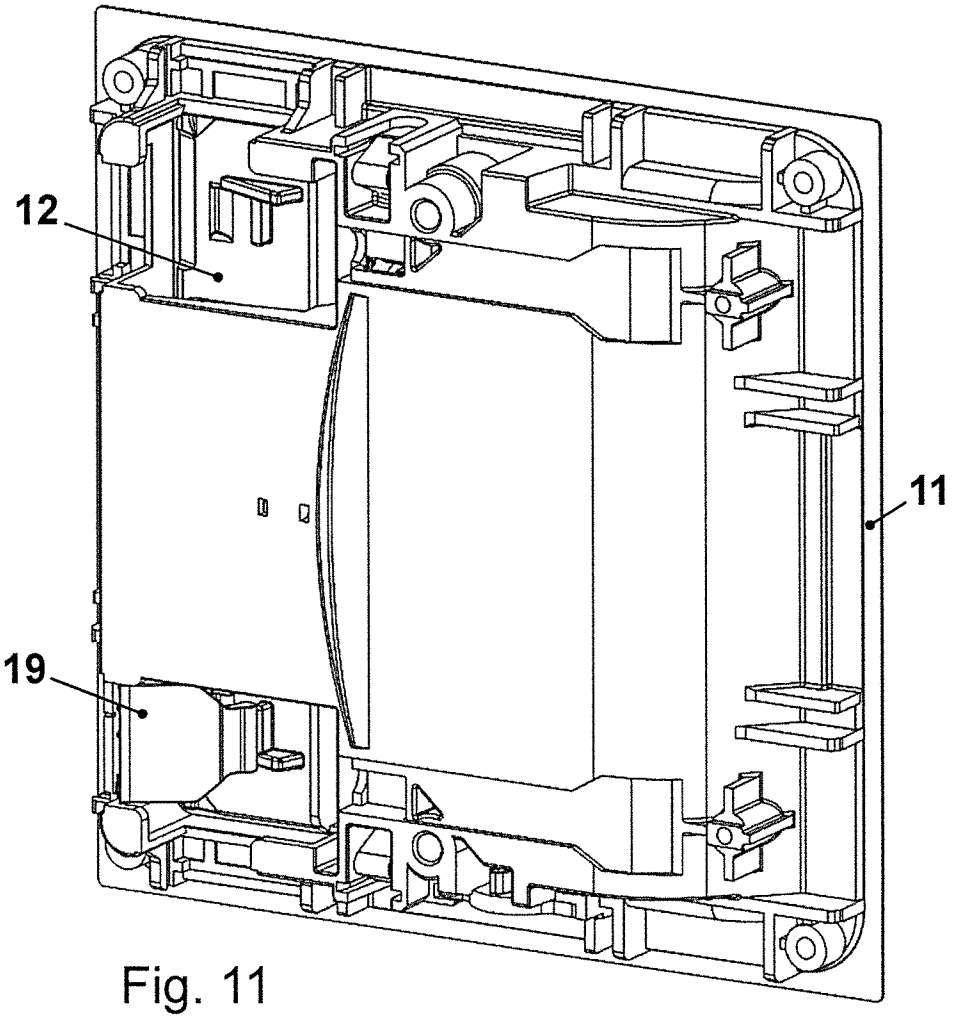
Figure 10:
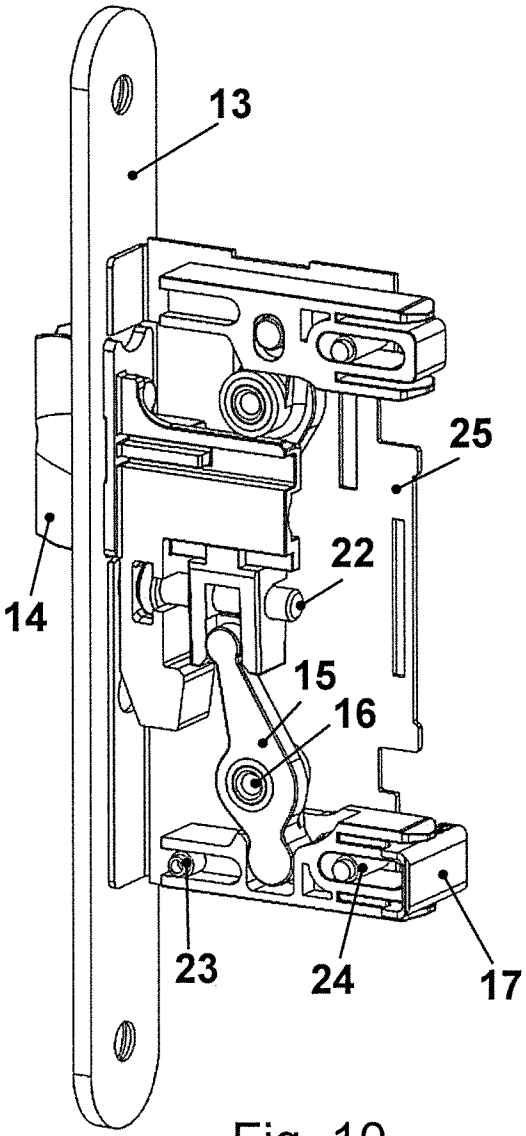
Figure 12:
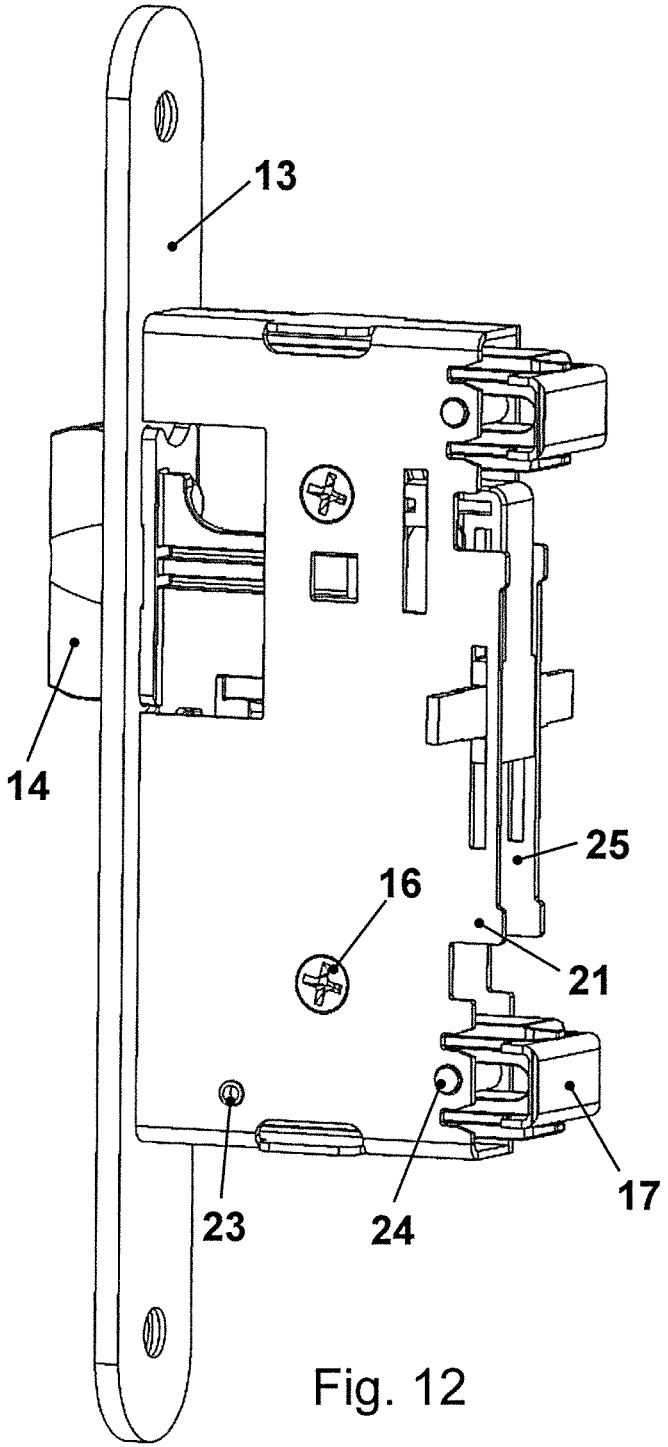
Figure 13:
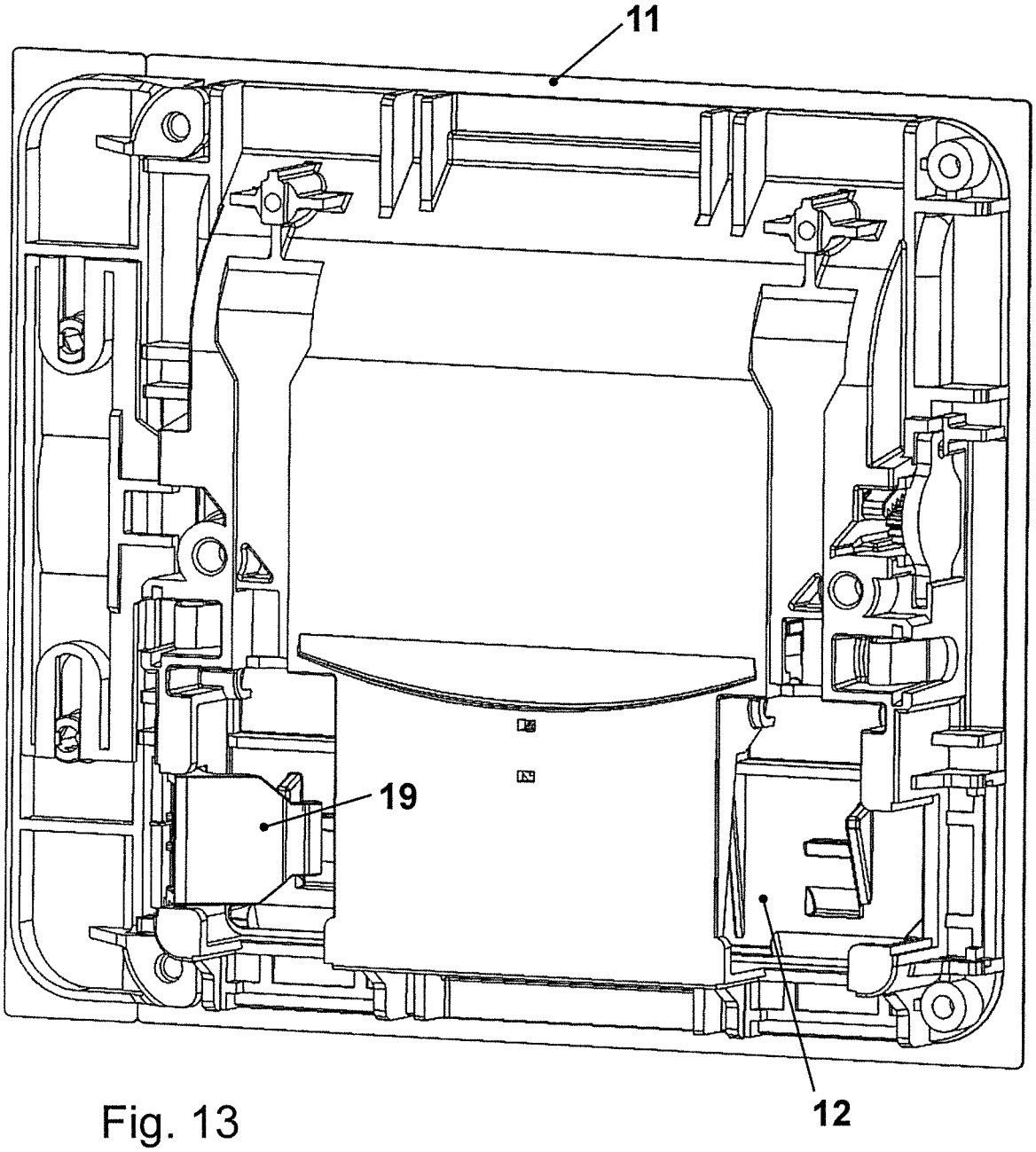

The invention will be described in further detail in an exemplary embodiment in conjunction with the accompanying drawings. They show:

FIG. 1, a frame countersunk in the door, having a recessed handle open toward the top; the deadbolt 14 protrudes from the front side of the door 10;

FIG. 2, the device of the door closer mechanism, which is countersunk in the door 10; FIG. 2 shows the frame 11 with the recessed handle 12 from behind;

FIG. 3, the components which cooperate with one another in the door closer mechanism;

FIGS. 4 and 5, the components of the device of FIG. 2 with the recessed handle 12 open toward the top;

FIGS. 6 and 7, the components of the device with the recessed handle 12 open at the bottom;

FIGS. 8 and 9, the components of the device with the recessed handle 12 open to the left;

FIGS. 10 and 11, the components of the device with the recessed handle 12 open to the right; and FIGS. 12 and 13, the components of the device of FIG. 2 with the recessed handle 12 open toward the top.

FIG. 1 shows a detail of a door 10, in which there is a countersunk a frame 11 that has a recessed handle 12 open toward the top. In the closing position, the deadbolt 14 protrudes from the vertical front side of the door 10. This deadbolt 14 is guided in a plate 13, which is connected to the front side of the door 10. The plate 13 is let flush into the front side of the door 10.

FIG. 2 shows two components of the device, which are countersunk in the door 10 from the back side. In the component that is provided with the plate 13, the components are covered by a plate 21. On the back side of this component, a slide 17 protrudes outward, and an angled control piece 19 is associated with it. The back side of the frame 11 is provided with the angled control piece 19 and the recessed handle 12 in such a way that upon actuation of the recessed handle 12, the angled control piece 19 is rotated and in the process adjusts the slide 17 parallel to the deadbolt 14.

As can be seen from FIG. 3, upon an adjustment of the slide 17, the lever 15 is rotated about the locator pin 16. In the process, the deadbolt 14 is drawn inward on the locator pin 22 and in the process moved entirely out of the receptacle in the door frame (not shown). The door closer mechanism assumes its opening position, and the door 10 can be opened. The slide 17 is provided, in the vicinity of the locator pins 23 and 24, with guide receptacles that permit the slide 17 to be adjusted parallel to the deadbolt 14. The plate 13 is connected to a plate 25 vertical to it, which has the locator pins 16, 23 and 24. The lever 15 is coupled with the slide 17 and the deadbolt 14, so that a rotation of the lever 15 causes the deadbolt 14 to be retracted.

FIGS. 4 and 5 show the two component groups in the door 10 in separate drawings. The drawings show that an angled control piece 19, which is rotatably located in the frame 11 of the recessed handle 12, is associated with the slide 17. The angled control piece 19 executes its rotary motion then when the recessed handle 12 is swung outward from the frame 11. This rotary motion is transmitted to the slide 17, which as a result causes the retraction motion and adjustment of the deadbolt 14 into the opening position.

As FIGS. 6 and 7 show, the recessed handle 12 can also be built into the frame 11 in such a way that the recessed handle is open toward the bottom. The angled control piece 19 is then associated with a second slide 17, which is longitudinally adjustable on the plate 25 and rotates a lever 15, which causes the deadbolt 14 to be retracted and puts the door closer mechanism into the opening position.

In FIGS. 8 and 9, the recessed handle 12 is built into the frame 11 in such a way that the recessed handle 12 is open toward the left. The angled control piece 19 rotatably supported in the frame 11 is, with an extension 26 on the side facing toward the slide 17, embodied as an adjustable part 19 and in the process initiates the retraction of the deadbolt 14 and thus puts the door closer mechanism into the opening position.

Finally, FIGS. 10 and 11 show the recessed handle 12 in a position in which it is open toward the right in the frame 11. Here, the angled control piece 19 is associated directly with the slide 17.

FIGS. 12 and 13 show the components in the door 10 in separate drawings and are counterparts of FIG. 2.

With FIGS. 4 through 13, it is shown that the incorporation of the recessed handle 12 into the frame 11 can be accomplished in four different positions. Thus the actuation of the recessed handle 12 is adapted to the most favorable conditions, without losing the advantages of the invention.

The invention claimed is:

1. A door closer mechanism having a receptacle, countersunk in the door frame, for the deadbolt (14) of a device, countersunk in the door, for controlling the deadbolt (14) from the closing position to the opening position by means of a manually controllable actuation member (12), characterized in that the actuation member (12) of the device countersunk in the door is embodied as a recessed handle (12), which in the closing position, via a rotatably supported angled control piece (19), controls at least one of a plurality of slides (17), and the at least one of a plurality of slides (17), via a rotatably supported lever (15), secures the deadbolt (14) in the receptacle in the door frame;

that upon actuation of the recessed handle (12) in the door (10), via the angled control piece (19) and the at least one of a plurality of slides (17), the deadbolt (14) can be adjusted into the opening position of the door (10), and the door (10) is enabled to open; and the device with the recessed handle (12) can be built into the door in such a way that it assumes four different positions, each rotated by 90° from one another, and the recessed handle (12) can be swung toward the bottom, to the left, toward the top and to the right, out of the frame (11) that is joined to the door.

2. The door closer mechanism of claim 1, characterized in that the recessed handle (12) is let flush into a frame (11) of the device in the door and can be swung out of the frame (11) and thereby adjusts the angled control piece (19), the at least one of a plurality of slides (17), and the lever (15) such that the deadbolt (14) moves out of the receptacle in the door frame.

3. The door closer mechanism of claim 1, characterized in that the recessed handle (12), except for an opening in the handle, extends beyond the frame (11) and thus makes it easier to grasp the recessed handle (12) for actuating the door closer mechanism.

4. The door closer mechanism of claim 1, characterized in that the recessed handle (12) is coupled with the angled control piece (19) in such a way that when the recessed handle (12) is swung outward, the angled control piece (19) is rotated and the at least one of a plurality of slides (17) can be adjusted parallel to the deadbolt (14); and that the at least one of a plurality of slides (17) rotates the lever (15) so far that the deadbolt (14) has moved all the way out of the receptacle in the door frame.

5. The door closer mechanism of claim 4, characterized in that the deadbolt (14) is guided in a plate (13) that is connectable to the front side of the door;

that this plate (13) is connected to a plate (25), at a right angle to it, that has the locator pins (16, 23, 24) for rotationally supporting the lever (15) and for adjusting the at least one of a plurality of slides (17), and the lever (15) is rotatably supported on the locator pin (16), and the at least one of a plurality of slides (17) provided with guide receptacles is slideable onto the locator pin (23, 24).

6. The door closer mechanism of claim 1, characterized in that the lever (15), the at least one of a plurality of slides (17) and the deadbolt (14) are covered by a plate (21) that is parallel to the plate (25).

7. The door closer mechanism of claim 1, characterized in that the angled control piece (19) in the frame (11) is rotatably supported around the recessed handle (12).

* * * * *